United States Patent [19]

Bradlee

[11] Patent Number: 4,765,169

[45] Date of Patent: Aug. 23, 1988

[54] METHOD OF TENSION LEVELING NONHOMOGENEOUS METAL SHEET

[75] Inventor: Charles R. Bradlee, Sidney, Ohio

[73] Assignee: The Monarch Machine Tool Co., New Bremen, Ohio

[21] Appl. No.: 115,673

[22] Filed: Nov. 2, 1987

[51] Int. Cl.[4] ..... B21D 1/02; B21D 37/16; B21B 27/00

[52] U.S. Cl. ..... 72/160; 72/13; 72/202

[58] Field of Search ..... 72/13, 160, 202, 205, 72/342

[56] References Cited

U.S. PATENT DOCUMENTS

| | | | |
|---|---|---|---|
| 1,718,806 | 6/1929 | Witting | 72/202 |
| 3,429,164 | 2/1969 | Oganowski | 72/202 |
| 4,635,458 | 1/1987 | Bradlee | 72/165 |

FOREIGN PATENT DOCUMENTS

| | | | |
|---|---|---|---|
| 463523 | 3/1950 | Canada | 72/202 |
| 74301 | 6/1981 | Japan | 72/342 |
| 42122 | 3/1984 | Japan | 72/13 |

*Primary Examiner*—Daniel C. Crane
*Attorney, Agent, or Firm*—Smith & Schnacke

[57] ABSTRACT

A method of tension leveling a continuous strip of non-homogeneous metal sheet in which the yield strength of the strip edges is less than the yield strength of the center. The method includes the steps of unwinding the strip from a coil supported on an uncoiler, passing the strip through tension-generating bridle rolls and, while under tension is passed, in a serpentine path between upper and lower sets of nested work rolls and through tension relaxing bridle rolls, and rewinding the strip into a coil on a recoiler. The improvement consists of the additional step of, prior to passing the strip between the work rolls, heating the strip edges to a temperature above that of the center of the sheet to create thermal expansion in the edges sufficient to produce a thermal strain such that, when added to an elastic strain at yield in the edges, total strain is equal to an elastic strain at yield in the center of the sheet. The result is that on relaxation and cooling, the total elastic and thermal contraction of the heated area is the same as the elastic contraction of the balance of the sheet. In a preferred embodiment of the invention, the heating step includes the step of continuously passing the edges of the strip adjacent to a heating element to produce the required temperature elevation.

3 Claims, 1 Drawing Sheet

METHOD OF TENSION LEVELING NONHOMOGENEOUS METAL SHEET

BACKGROUND OF THE INVENTION

The present invention relates to methods of tension leveling strip steel and, more particularly, methods of tension leveling strip steel to produce substantially flat strips of sheet steel.

In the process of rolling metal into strips, certain variables exist which create a lack of flatness that causes the strip of material to deviate from a planar configuration. In order to correct the defects which cause a variation in uniformity across the width of the rolled strip, a process known as tension leveling is employed.

A tension leveling apparatus typically includes sets of upper and lower work rolls which are nested relative to each other and are supported by back-up rolls along their lengths. Metal strip is fed through the nested rolls in a serpentine path and at least the portion of the strip passing through the leveling apparatus is placed under tension and elongated. As the strip passes through the work rolls, it is bent around the radii of the work rolls so that the upper and lower surfaces of the strip are alternately elongated and compressed in a tranverse direction. The result is an elongation of the strip across its width which imparts the requisite flatness to the strip. An example of such a tension leveling apparatus is disclosed in Bradlee U.S. Pat. No. 4,635,458, the disclosure of which is incorporated herein by reference.

However, the effectiveness of such tension leveling devices in producing uniformity across the width of metal is reduced as a result of variations in yield strength across the width of the strip. Such variations result from the casting technique and are more pronounced in the older ingot casting processes than in the more recently developed continuous casting processes. Because the yield stress varies across the sheet, the elastic strain imparted by a tension leveling apparatus also varies. If the sheet edge has a lower yield strength, as is frequently the case, the center portion of the sheet will contract more than the edges after the strip emerges from the tension leveling apparatus.

This additional contraction of the center area causes the metal in the edges of the strip to be placed in compression, thereby causing the edges to collapse to form a wavy edge. Accordingly, there is a need for a technique for compensating for variations in yield strength across the width of a sheet which is to be tension leveled in the aforementioned manner.

SUMMARY OF THE INVENTION

The present invention is a method of tension leveling nonhomogeneous metal sheet of the type in which an area adjacent to the longitudinal edges of the sheet has a lower yield strength than the remainder of the sheet such that any differences in yield strength are compensated for during the leveling process. The method of the invention includes the steps of unwinding a strip of metal sheet from a coil supported on an uncoiler, passing the sheet under tension in a serpentine path between upper and lower sets of nested work rolls which impart a plastic strain to the sheet, and rewinding the sheet into a coil on a recoiler.

Prior to passing the sheet between the work rolls of the leveling apparatus, the edges of the sheet are heated to a temperature sufficient to create thermal expansion which, when added to the elastic strain at yield in the edges, equals the elastic strain at yield in the central portion of the sheet. Consequently, the plastic strain imparted to the sheet by the work rolls is followed, on relaxation of the leveling tension, by an elastic contraction at the center and an equal contraction at the edges comprising both elastic and thermal contraction.

In a preferred embodiment of the invention, the edges of the metal strip are passed beneath gas burners which heat the edges to a predetermined temperature above the temperature of the remainder of the strip to impart the requisite thermal strain. The advantage of the process step of the preferred embodiment is that the strip can be heated on a continuous basis prior to entering the work rolls of the tension leveling apparatus.

Accordingly, it is an object of the present invention to provide a method for tension leveling strips of metallic material which compensates for variations in yield strength across the width of the strip; a method which can be incorporated into known tension leveling devices; and a method which is relatively inexpensive to perform and uses components which are relatively unaffected by the adverse environment in which tension leveling typically occurs.

Other objects and advantages of the present invention will become apparent from the following description, the accompanying drawings and the appended claims.

DETAILED DESCRIPTION OF THE PREFERRED EMBODIMENT

Figure 1:
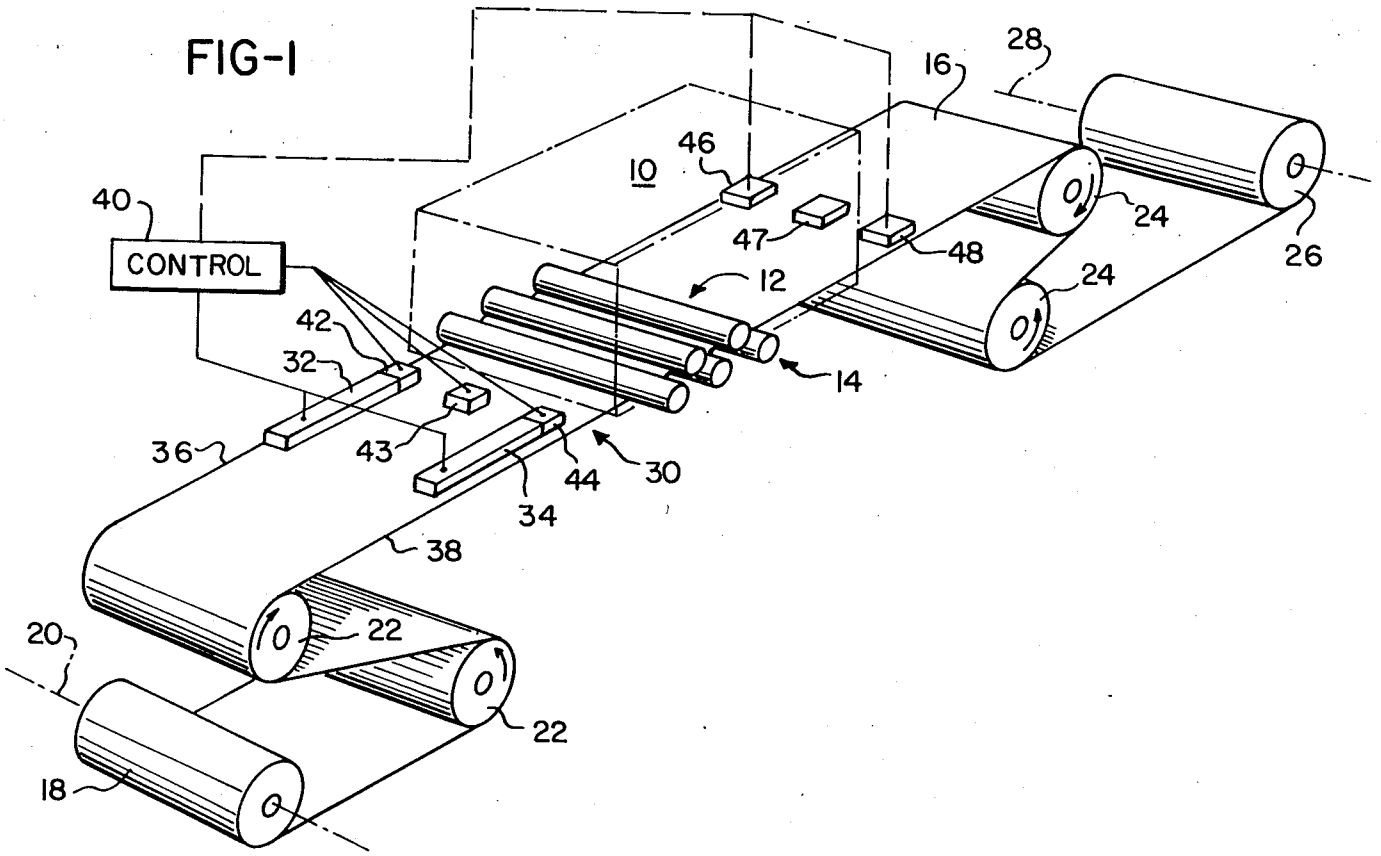
FIG. 1 is a perspective, schematic view of a tension leveling apparatus which incorporates a preferred embodiment of the method of the present invention.

As shown in FIG. 1, the method of the present invention incorporates a tension leveling apparatus, generally designated 10, such as the leveling apparatus disclosed in the aforementioned Bradlee U.S. Pat. No. 4,635,458. The leveling apparatus 10 includes upper and lower sets of work rolls 12, 14, respectively, which are nested relative to each other. The nested sets of work rolls 12, 14 form a serpentine path for a continuous strip 16 of sheet metal such as steel.

The strip 16 is unwound from a coil 18 supported on an uncoiler 20. The strip 16 is passed about a set of bridle rolls 22, through the leveling apparatus 10, about a second set of bridle rolls 24, and is recoiled into a coil 26 supported on a recoiler 28. The speeds of the bridle rolls 22 and 24 are controlled to apply an appropriate amount of elongation to the strip 16 as it passes through the leveling apparatus 10.

The leveling apparatus 10, uncoiler 20 and recoiler 28, and rollers 22 and 24 together comprise a leveling system, generally designated 30. This leveling system 30 also includes a pair of strip heating elements, which in the preferred embodiment are gas burners 32, 34. The strip heating elements 32, 34 are positioned to lie above and/or below and extend along the longitudinal edges 36, 38 of the strip 16 at a location upstream of the leveling apparatus 10. Consequently, when actuated, the elements 32, 34 convey heat energy to a relatively narrow portion, on the order of 1–3 inches along the longitudinal edges 36, 38.

The heating elements 32, 34 are actuated by a computer control 40, which receives temperature data from an upstream pair of optical pyrometers 42, 44, and a downstream pair of optical pyrometers 46, 48.

The method of operation is as follows. Initially, the variation in yield strength across the width of the strip 16 is determined by measuring the hardness of the strip across its width. Hardness numbers can readily be converted to yield strengths for a given material. From this, a variation in yield strength ($\Delta S_y$) between the center of the strip and the longitudinal edges 36, 38 is determined. The variation in the amount of strain due to the variation in yield strength is determined by the following equation:

$$\Delta\epsilon = \frac{\Delta S_y}{E} \quad (1)$$

where $\Delta\epsilon$ is the differential elastic strain, and E is the elastic modulus for the material comprising this strip. The temperature difference ($\Delta t$) between the center and the edges 36, 38 of the strip 16 necessary to compensate for the strain deficit is determined by the following equation:

$$\Delta t = \frac{\Delta\epsilon}{\alpha} \quad (2)$$

where $\alpha$ is the thermal coefficient of expansion.

Once $\Delta t$ is calculated, the control 40 can be programmed to actuate the heating elements 32, 34 to raise the temperature of the edges of the strip 16 to a predetermined level, which is read by optical pyrometers 42, 43, 44, 46, 47, 48. In performing the method, it is necessary that this value be present as the strip 16 emerges from the leveling apparatus 10. As a result of this heating, the edges 36, 38 are expanded by a predetermined amount prior to their entering the sets of work rolls 12, 14.

The resultant strain imparted to the strip 16 by passing under tension around the small radii of the work rolls (which are on the order of an inch to three inches) results in a uniformly elongated strip emerging from the leveling apparatus 10. After passing bridles 24 the lower yield strength material at the longitudinal edges 36, 38 contracts elastically a lesser amount than the higher yield strength material at the center. However, by preheating these areas prior to the working by the work rolls 12, 14, the material in the area of the edges will continue to contract upon cooling to the same temperature as the center, offsetting the deficit of elastic contraction.

For example, assume that a strip of steel having an elastic modulus of 30,000,000 p.s.i., an $\alpha$ of 0.0000065 in./in./° F. and a $\Delta S_y$ of 3,000 p.s.i. is to be tension leveled. Substituting these values into equation (1) yields:

$$\Delta\epsilon = \frac{3{,}000 \text{ p.s.i.}}{30{,}000{,}000 \text{ p.s.i}} = 0.0001 \text{ in./in.}$$

Substituting for the variables $\Delta\epsilon$ and $\alpha$ in equation (2) yields:

$$\Delta t = \frac{.0001 \text{ in./in.}}{.0000065 \text{ in./in./°F.}} = 15° \text{ F.}$$

Assuming that the strip has a thickness (T) of 0.050 in., a speed (V) through the leveling apparatus 10 of 1,000 ft./min., a width (W) of strip to be heated of 2 in./side, a density (d) of 0.2833 lbs./in.$^3$, a temperature change ($\Delta t$) of 15° F. and a specific heat ($C_p$) of 0.117 btu/lb./° F. and a temperature change ($\Delta t$) of 15° F., the amount of heat energy (Q btu/min.) is given by the following equation:

$$(3) Q = T \times 2W \times V \times d \times C_p \times \Delta t$$

Substituting these values into equation (3) yields:

$$\begin{aligned} Q &= (.05 \text{ in.}) \times (4 \text{ in.}) \times (12{,}000 \text{in./min.}) \times (.2833 \\ &\quad \text{lbs./in.}) \times (.117 \text{ btu./lb./°F.}) \times (15° \text{ F.}) \\ &= 1193 \text{ btu./min.} \end{aligned}$$

Consequently, the amount of heat necessary to be added per minute would require only a modestly sized gas burner. It is within the scope of the invention to provide other conventional types of heating such as induction or radiation heating. The specific method of heating would depend mainly upon the cost of energy in the locality where the method is performed. Other factors such as the space available, the degree of control desired, the type of material being leveled and the material surface condition are also important.

While the forms of apparatus and methods disclosed constitute a preferred embodiment of this invention, it is to be understood that this invention is not limited to this precise method and form of apparatus and that changes may be made therein without departing from the scope of the invention.

What is claimed is:

1. In a method of tension leveling a strip of continuous, nonhomogeneous metal sheet of the type in which an area adjacent to a longitudinal edge of said sheet has a lower yield strength than a remainder thereof, wherein said sheet is unwound from a coil supported on an uncoiler, said sheet is passed, under tension, in a serpentine path between upper and lower sets of nested work rolls which impart a controlled plastic strain to said sheet, and said sheet is rewound into a coil on a recoiler, the improvement comprising the step of:

prior to passing said sheet between said work rolls, heating said area to a temperature above a temperature of said remainder to create thermal expansion in said area sufficient to produce a thermal strain in said area such that when added to elastic strain at yield in said area, is equal to an elastic strain at yield in said remainder of said sheet and passing said heated sheet along said serpentine path in said nested work rolls.

2. The method of claim 1 wherein said heating step includes the step of raising said temperature of said area above an amount $\Delta t$ above said temperature of said remainder where $$\Delta t = \frac{\Delta S_y}{E\alpha},$$

where $\Delta S_y$ is the difference in yield strength between said area and said remainder, E is the modulus of elasticity of said sheet, and $\alpha$ is the coefficient of thermal expansion of said sheet.

3. The method of claim 1 wherein said heating step includes continuously passing said area of said strip adjacent to means for heating said area to said temperature above said temperature of said remainder.

* * * * *